US010077170B2

(12) United States Patent
Schwabenthan et al.

(10) Patent No.: US 10,077,170 B2
(45) Date of Patent: Sep. 18, 2018

(54) DEVICE FOR THE HAND-GUIDED MOVEMENT OF LOADS

(71) Applicant: J. SCHMALZ GMBH, Glatten (DE)

(72) Inventors: Klaus-Dieter Schwabenthan, Balingen (DE); Jonas Mast, Baiersbronn (DE); Valentin Schmidt, Stuttgart (DE); Kay Woeltje, Weil im Schoenbuch (DE); Werner Kraus, Stuttgart (DE)

(73) Assignee: J. SCHMALZ GMBH, Glatten (DE)

( * ) Notice: Subject to any disclaimer, the term of this patent is extended or adjusted under 35 U.S.C. 154(b) by 380 days.

(21) Appl. No.: 14/780,624

(22) PCT Filed: Apr. 24, 2014

(86) PCT No.: PCT/EP2014/058331

§ 371 (c)(1),
(2) Date: Sep. 28, 2015

(87) PCT Pub. No.: WO2014/174006

PCT Pub. Date: Oct. 30, 2014

(65) Prior Publication Data

US 2016/0068371 A1 Mar. 10, 2016

(30) Foreign Application Priority Data

Apr. 26, 2013 (DE) ..... 10 2013 207 643

(51) Int. Cl.
*B66C 1/02* (2006.01)
*B66C 13/18* (2006.01)
(Continued)

(52) U.S. Cl.
CPC ..... *B66C 13/18* (2013.01); *B66C 11/16* (2013.01); *B66C 23/027* (2013.01); *B66C 23/48* (2013.01); *B66C 23/68* (2013.01); *B66D 3/18* (2013.01)

(58) Field of Classification Search
CPC ..... B66C 1/02; B66C 1/0225; B66C 1/0275; B66C 11/16; B66C 11/24; B66C 13/08;
(Continued)

(56) References Cited

U.S. PATENT DOCUMENTS 5,865,426 A * 2/1999 Kazerooni ..... B66C 1/62 212/285
5,915,673 A * 6/1999 Kazerooni ..... B66C 1/62 212/285
(Continued)

FOREIGN PATENT DOCUMENTS

CN 201002931 1/2008
CN 202132477 2/2012
(Continued)

OTHER PUBLICATIONS

English Language Abstract of JP 2003-063800.
(Continued)

*Primary Examiner* — Emmanuel Monsayac Marcelo
(74) *Attorney, Agent, or Firm* — Ware, Fressola, Maguire & Barber LLP

(57) ABSTRACT

The invention relates to a device (10) for the hand-guided movement of loads by means of a retaining or gripping element (11) as a lifting aid, which retaining or gripping element is attached to a load-bearing rope (2), comprising a load-bearing apparatus (1), which is provided with at least one vertical cantilever (3), over which the load-bearing rope (2) is guided from sides of a rope-winding apparatus (4) on the load-bearing apparatus (1) by means of an adjustable rope articulation point (5), wherein a sensor (6) for measuring a rope angle of the load-bearing rope (2) in relation to the vertical is provided and a controller coupled to the sensor (6) is provided, which controller is designed to simultaneously control an adjustment of the rope articulation point (5) and
(Continued)

a rope length of the load-bearing rope (2) on the basis of a measured rope angle.

20 Claims, 7 Drawing Sheets

(51) Int. Cl.

| | |
|---|---|
| ***B66C 23/02*** | (2006.01) |
| ***B66D 3/18*** | (2006.01) |
| ***B66C 11/16*** | (2006.01) |
| ***B66C 23/48*** | (2006.01) |
| ***B66C 23/68*** | (2006.01) |

(58) Field of Classification Search
CPC ..... B66C 13/18; B66C 23/027; B66C 23/16; B66C 23/42; B66C 23/48; B66C 23/68; B66D 3/18
See application file for complete search history.

(56) References Cited

U.S. PATENT DOCUMENTS

| | | | | |
|---|---|---|---|---|
| 6,668,668 | B1 * | 12/2003 | Peshkin | B66C 13/18 324/207.15 |
| 7,070,061 | B1 * | 7/2006 | Munnekehoff | B66C 23/005 212/328 |
| 2002/0079850 | A1 * | 6/2002 | Hortig | B66D 3/18 318/2 |
| 2002/0113448 | A1 * | 8/2002 | Kazerooni | B25J 15/00 294/86.4 |
| 2004/0026349 | A1 | 2/2004 | Colgate | |
| 2004/0143364 | A1 * | 7/2004 | Colgate | B66C 13/063 700/213 |
| 2004/0155004 | A1 | 8/2004 | Laundry | |
| 2006/0226106 | A1 * | 10/2006 | Zaguroli, Jr. | B66C 9/14 212/331 |
| 2007/0205405 | A1 * | 9/2007 | Stockmaster | B66D 1/56 254/275 |
| 2012/0168397 | A1 * | 7/2012 | Lim | B66C 13/063 212/273 |
| 2013/0112643 | A1 * | 5/2013 | Lecours | B66C 13/18 212/276 |

FOREIGN PATENT DOCUMENTS

| | | |
|---|---|---|
| EP | 1551747 | 11/2012 |
| FR | 453260 | 6/1913 |
| GB | 136660 | 1/1920 |
| JP | S56-128510 | 10/1981 |
| JP | S63-226809 | 9/1988 |
| JP | H10-187221 | 7/1998 |
| JP | 2001-039683 | 2/2001 |
| JP | 2002-017795 | 1/2002 |
| JP | 2003-063800 | 3/2003 |

OTHER PUBLICATIONS

English Language Abstract of JP 2002-017795.
English Language Abstract of JP J10-187221.
English Language Abstract of JP 2001-039683.
English Language machine translation of JPS56-128510—Description only.
English Language machine translation of JPS63-226809—Description only.

* cited by examiner

DEVICE FOR THE HAND-GUIDED MOVEMENT OF LOADS

This application corresponds to international patent application serial no. PCT/EP2014/058331, filed 24 Apr. 2014, which claims benefit to German patent application serial no. 10 2013 207 643.6, filed 26 Apr. 2013, which is incorporated by reference in their entirety.

BACKGROUND OF THE INVENTION

1. Field of the Invention

The present invention relates to a device for the hand-guided movement of loads by means of a retaining or gripping element as a lifting aid, which retaining or gripping element is attached to a load-bearing rope. In such lifting aids, a load-bearing rope is guided along a cantilever, which is horizontally aligned, for example, which can be wound in or unwound over a cable or rope winch to in order to lift loads to be conveyed. As retaining element, various types of grippers are used, such as, for example, vacuum grippers, by means of which the loads can be attached to the end of the rope by an operator. The cantilever of the load-bearing apparatus generally can be swiveled to the side, and a rope articulation point on the cantilever is adjusted via an adjustment mechanism in the longitudinal direction of the cantilever, so that the load can be shifted from an original site to a destination site. After picking up the load by means of the retaining or gripping element, the operator of the device manipulates the load by hand in order to shift it to its destination site and deposit it there.

2. Description of Related Art

EP 1 551 747 B1 shows a device for preventing instabilities in such lifting aid devices, which comprises a trolley that can be shifted on a vertical support. A rope winch for a load-bearing rope is attached to the trolley. If an operating person wishes to perform a shifting of a load that has been picked up, the shifting is started by a sideways pushing of the load, so that the load-bearing rope is deflected from the vertical into a slanted alignment. Depending on the measured deflection, the magnitude and direction of the shift of the laser are determined. The trolley is then activated in the direction towards an adjustment of the rope angle with respect to the vertical. The speeds of the trolley is determined based on the direction and magnitude of the deflection angle of the rope. The rope winch is moved together with the trolley along the vertical cantilever. Therefore, a correspondingly dimensioned trolley and load-bearing apparatus as well as a comparatively large drive for the adjustment of the trolley are necessary.

The present invention is based on the problem of providing a lifting aid which can be activated manually and which has a simple, light-weight and space-saving design.

This problem is solved with a device having the features of claim 1. Advantageous designs and refinements of the invention are the subject matter of the dependent claims.

The device according to the invention comprises a load-bearing apparatus with at least one cantilever which preferably extends horizontally and over which a load-bearing rope or load-bearing cable is guided from sides of a rope winding device (for example, a rope winch which is driven or can be driven) by means of a rope articulation point which can be shifted or adjusted particularly along the cantilever. At the free end of the load-bearing rope, a retaining or gripping element is attached, which is adapted for picking up loads, for example, in the form of a gripper, a hook or a suction gripper.

A sensor is provided for measuring a rope angle of the load-bearing rope relative to the vertical, and a controller is also provided, which is connected to the sensor and works together with said sensor. Said controller is designed for the simultaneous control of a shifting of the rope articulation point and of a rope length of the load-bearing rope on the basis of a measured rope angle. In particular, by means of the controller, both the rope winding device and also at least one actuating drive can be activated for the shifting of the rope articulation point as a function of the rope angle measured with the sensor.

If an operating person, by applying a lateral force to the load, moves the load-bearing rope from the vertical, the sensor acquires the corresponding deflection angle of the load-bearing rope from the vertical. The acquisition values of the sensor are transmitted to the controller. By means of the controller, an automatic adjustment of the rope articulation point along the cantilever of the load-bearing apparatus is produced. At the same time, the controller controls, in accordance with an adjustment of the rope articulation point, the rope winding device for the adaptation of the effective rope length of the load-bearing rope. This makes it possible, in particular, to keep the load at a constant height on the retaining element of the device. In this manner, the rope winch can be mounted stationarily, for example, on a vertical support, without the adjustment of the rope articulation point leading to an adjustment of the height of the load to be carried. On the cantilever itself, only the rope articulation point which can be adjusted by means of an actuating device is provided.

By means of the controller which is adapted especially for this purpose and connected to the sensor for the acquisition of the rope angle, an activation of the rope winding device thus occurs in such a way that, when the rope articulation point on the cantilever of the load-bearing apparatus is adjusted as a function of the rope deflection angle, the load-bearing rope is wound in or unwound in accordance with the degree of the adjustment, so that, while the carried load is indeed moved with the shift of the rope articulation point, the rope length between the rope articulation point and the carried load remains constant. Therefore, by means of the controller, as a function of the rope angle acquired by the sensor, not only the movement of the rope articulation point on the load-bearing apparatus is actively controlled, but, in addition, a winding up or unwinding of the load-bearing rope is produced in order to maintain the carrying height by the rope winch.

The rope winding device is mounted in particular stationarily on the load-bearing apparatus. For example, the rope winding device is attached at a rear end of the cantilever or on a vertical support of the load-bearing apparatus.

The controller comprises, in particular, a means for the active tracking of the rope articulation point on the cantilever of the load-bearing apparatus in a direction of adjustment of the rope angle of the load-bearing rope toward the vertical. If an operator of the device moves a held load in a certain direction (for example, forward), then the sensor acquires the magnitude of the angle of the load-bearing rope and transmits this value to the controller. In the controller, an algorithm, for example, is stored which produces a corresponding adjustment of the rope articulation point in the given direction (for example, forward). For this purpose, the rope articulation point is provided with a corresponding drive or actuating drive, by means of which a corresponding shift of the rope articulation point can be brought about, in such a manner that the load-bearing rope is moved back again towards the vertical.

The controller comprises, in particular, a means for keeping the rope length between the load and the cantilever constant in the case of a sideways shift of the load by a user. As a result, it is possible to ensure that the load is always at the height above the ground selected by the user. This facilitates the handling of the device according to the invention by a user, who needs to use less force when shifting the loads.

Preferably, a trolley which is adjustable on the load-bearing apparatus and which can be activated by the controller is provided between the rope articulation point and the cantilever. The trolley comprises, in particular, a drive means for shifting in the longitudinal direction of the cantilever.

The rope articulation point can be implemented, for example, by a deflection roll. The deflection roll is arranged on the trolley, for example. A trolley that can be driven automatically can be formed, for example, from a base body having a C-shaped cross section and used in a corresponding inverted T profiled part or H profiled part of the cantilever.

When an adjustment of the load-bearing rope from the vertical is acquired, the driven trolley is automatically moved by the controller in the direction which leads to a return of the load-bearing rope to the vertical (adjustment). The forces for moving the rope articulation point and the cantilever are thereby decoupled from the user, which is advantageous particularly in the case of rapid handling procedures, since the inert mass that has to be moved is reduced as a result.

In a further design, it is possible to provide actuating drives connected to the controller for adjusting the rope articulation point in the longitudinal direction of the cantilever and/or in a direction transverse to the longitudinal direction of the cantilever. For example, the trolley can be shifted and/or the arrangement (for example, rotation angle) of the cantilever on a support can be changed. In this manner, an active tracking of the position of the rope articulation point from front to back or from back to front, and optionally also sideways, can be performed by the cantilever of the load-bearing apparatus.

The cantilever can be arranged rotatably on a support, for example, on an axle that can be actively rotated about a vertical support. In this manner, a two-dimensional movement can be implemented with the cantilever.

Then, for example, two different actuating drives can be present, each connected to the controller which receives the respective rope angle, as input signal, from the sensor.

Advantageously, the load-bearing apparatus comprises a cantilever that can be swiveled sideways (particularly in the horizontal plane) on a vertical support, which is provided with an actuating drive for the active turning of the cantilever about a vertical rotation axle. The load-bearing apparatus can a comparatively simple structural design in the form of a substantially L-shaped lifting beam.

The load-bearing apparatus can also comprise a pivot arm cantilever with an additional vertical rotation axle on which a pivot joint which can be adjusted via an actuating drive is provided. In this manner, the radius of action of the device is further increased.

It is also conceivable for the load-bearing apparatus to comprise a scissor cantilever, in which two cantilevers or load-bearing arms coupled to one another by a joint are provided.

The sensor for the acquisition of the rope angle relative to the vertical can be formed as a one-dimensionally measuring deflection sensor or angle sensor, which is arranged at a predefined distance beneath the rope articulation point adjoining the load-bearing rope. Such a one-dimensional angle measurement of the rope angle relative to the load-bearing rope can be implemented using a so-called line sensor, for example. For the measurement of the rope angle, a laser can also be used, which is directed from top down onto the operating unit or the gripping element, in order to measure, in this manner, the deflection of the load-bearing rope from the vertical. Such a sensor can also be used advantageously for the acquisition of the rope length between the rope articulation point and the load to be carried.

According to another advantageous design of the invention, the rope articulation point is formed as a deflection roll with lift-off protection. This reduces the frictional forces that form at the time of the adjustment of the load-bearing rope on the rope deflection point. As a result, the winding up and the unwinding of the load-bearing rope are further accelerated.

BRIEF DESCRIPTION OF THE DRAWINGS

Below, the invention is explained in further detail in reference to the appended figures.

DETAILED DESCRIPTION OF THE BEST MODE OF THE INVENTION

Figure 1:
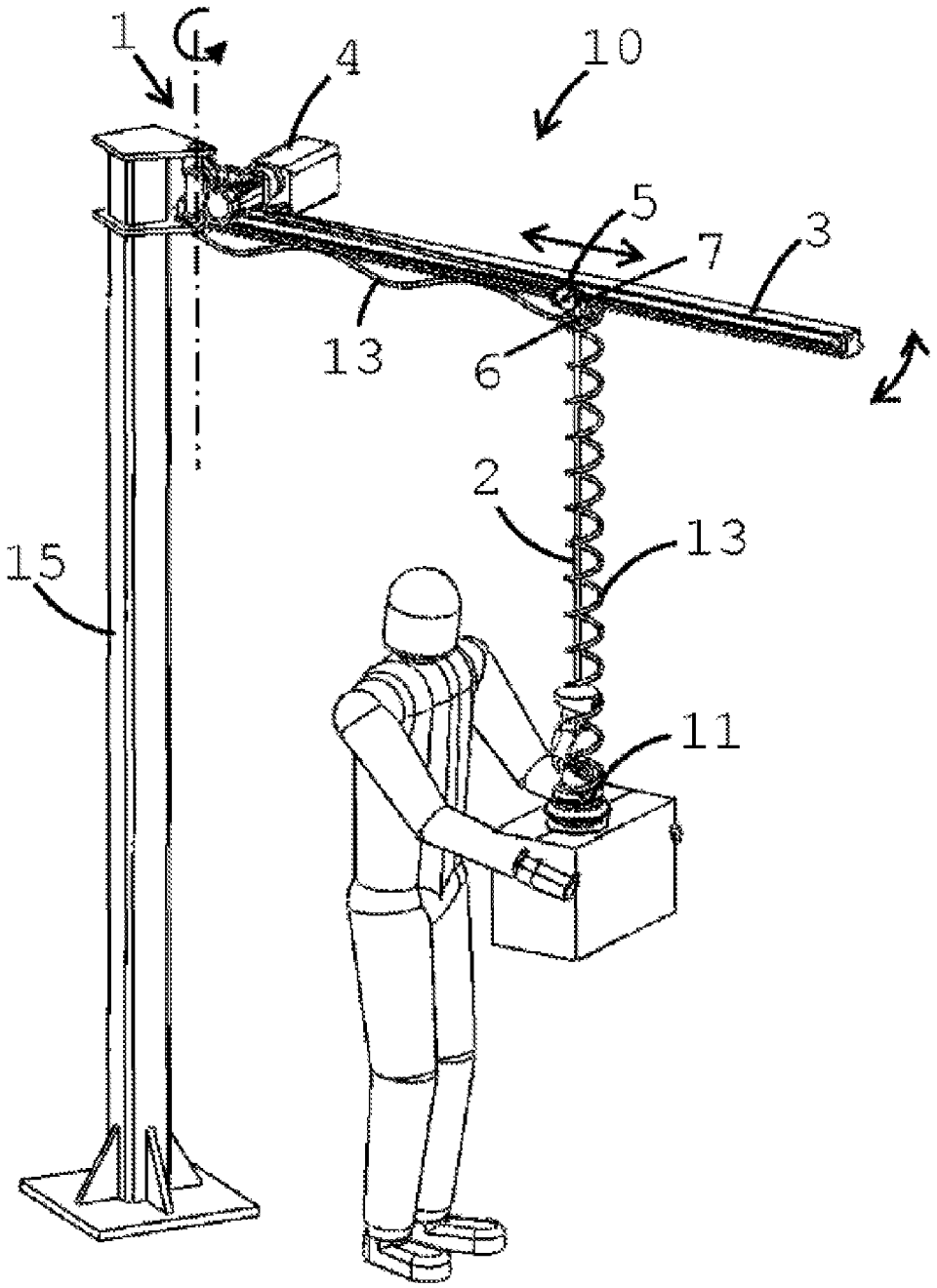
FIG. 1 shows a perspective view of a first embodiment example of the device according to the invention.
Figure 2:
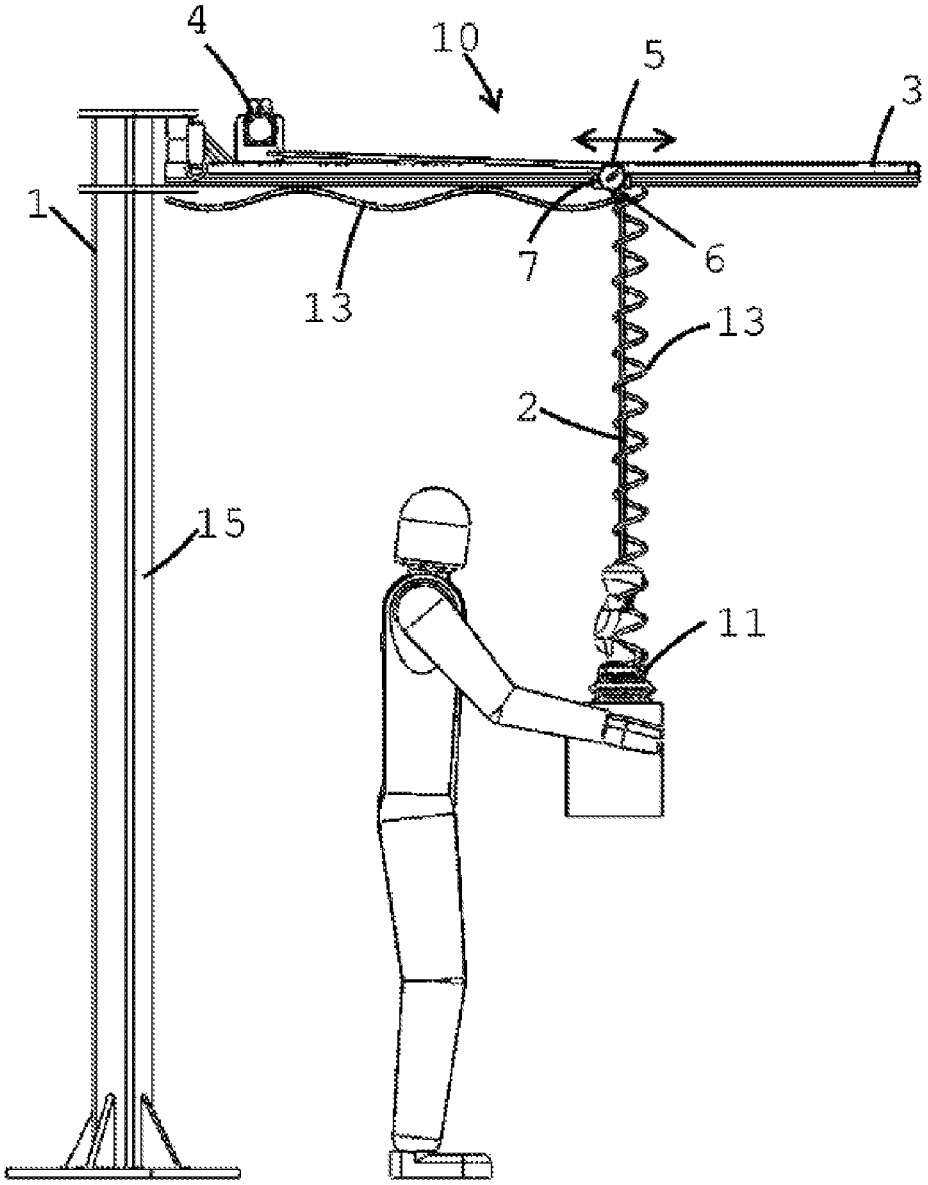
FIG. 2 shows a side view of the first embodiment example of the device according to the invention.

In FIG. 1 and FIG. 2, a first embodiment example of a device 10 according to the invention for the hand-guided movement of loads by means of a retaining or gripping element 11 is represented. The device 10 comprises a load-bearing apparatus 1 with a load-bearing rope 2 guided along it. At the lower end of the load-bearing rope 2, a gripping element 11 is provided, which is a vacuum gripper in this embodiment example. The gripping element 11 can be supplied with a vacuum pressure, for example, via a low-pressure line 13.

Independently of the concrete embodiment, it is also conceivable to provide, on the gripping element 11, a low-pressure generator (for example, an ejector) operated by pressurized air, or an electrically driven low-pressure generator, for example, integrated in the gripping element 11. In that case, the line 13 can be a pressurized air line 13 or an electrical supply line 13.

The load-bearing apparatus 1 here consists of a vertical post 15, at the top end of which a cantilever 3 is articulated so that it can be swiveled about a vertical axle. The load-bearing rope 2 is guided over a rope articulation point 5 on the cantilever 3, wherein the rope articulation point 5 can be adjusted in the longitudinal direction of the cantilever 3. In this manner, loads picked up with the vacuum gripper 11 can be shifted by an operating person to a target position, by adjusting the rope articulation point 5 on the cantilever 3 as well as the swivel direction of the cantilever 3 as desired. At the rear end of the cantilever 3, in the area of the rotation axle relative to the post 15, a rope winding device 4 is provided, by means of which the load-bearing rope 2 can be wound up for lifting loads and unwound for depositing loads.

Figure 3:
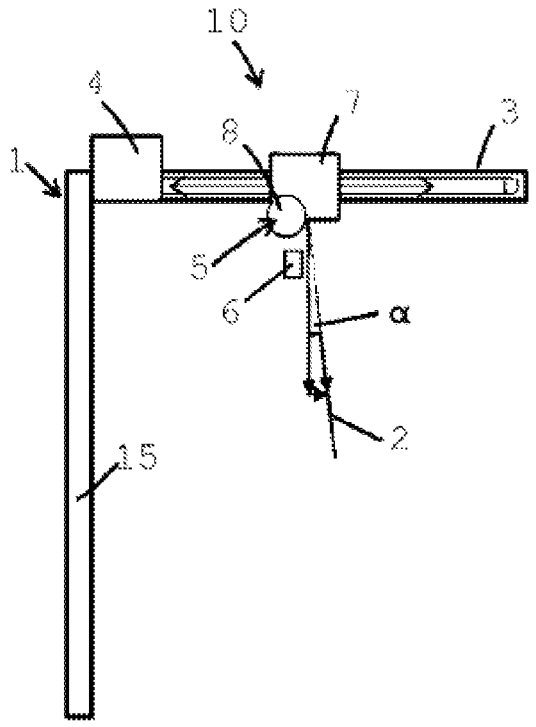
FIG. 3 and FIG. 4 show diagrammatic side views of an embodiment example of the device according to the invention in order to explain the principle of the invention of an active tracking of the rope articulation point.
Figure 4:
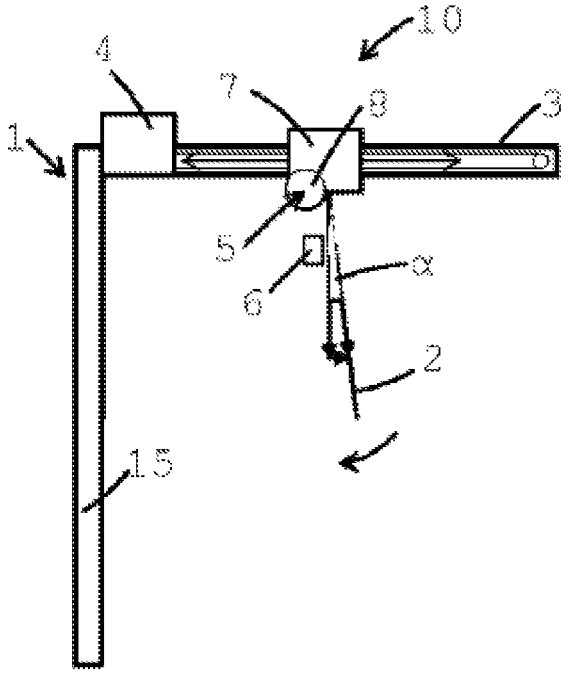
Figure 5:
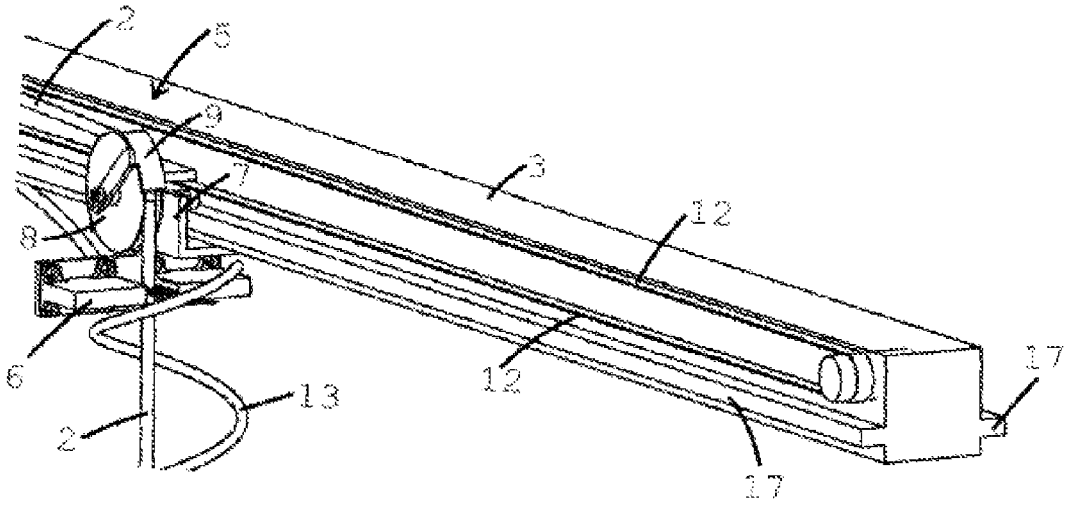
FIG. 5 shows a detail view in perspective of an embodiment example of the device according to the invention in the area of the rope articulation point.
Figure 6:
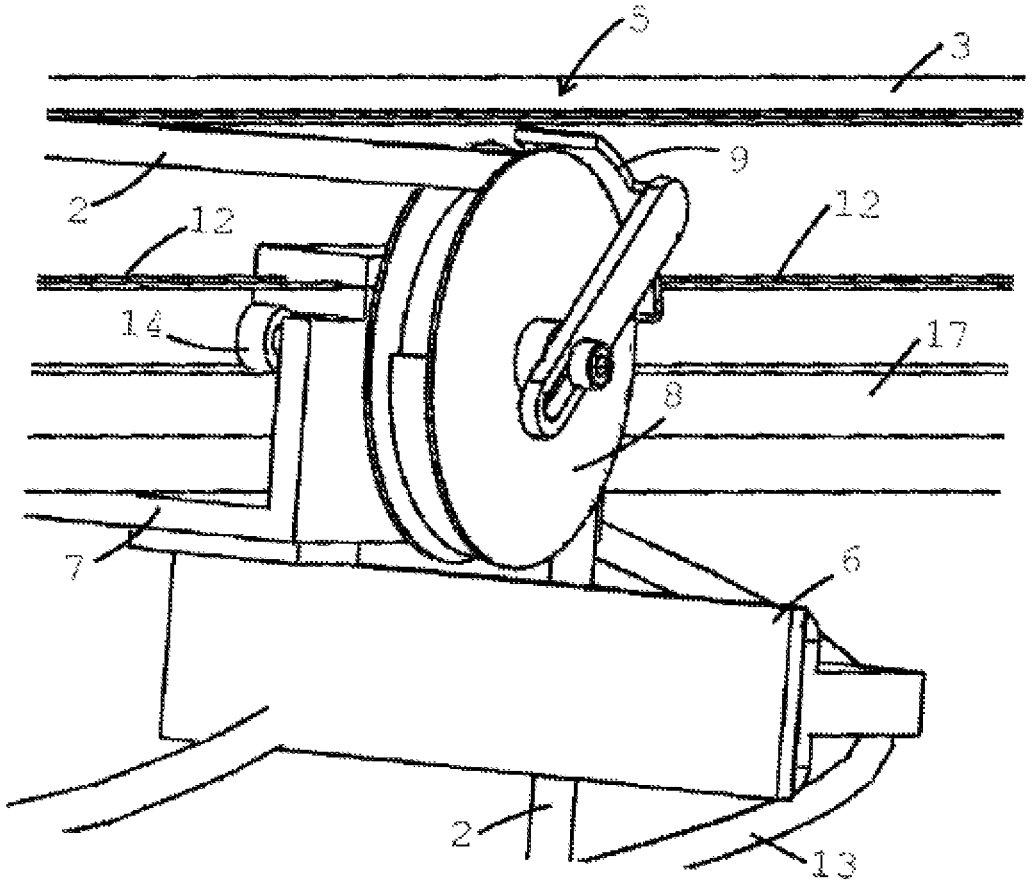
FIG. 6 shows a detail view in perspective of an embodiment example of the device according to the invention.
Figure 7:
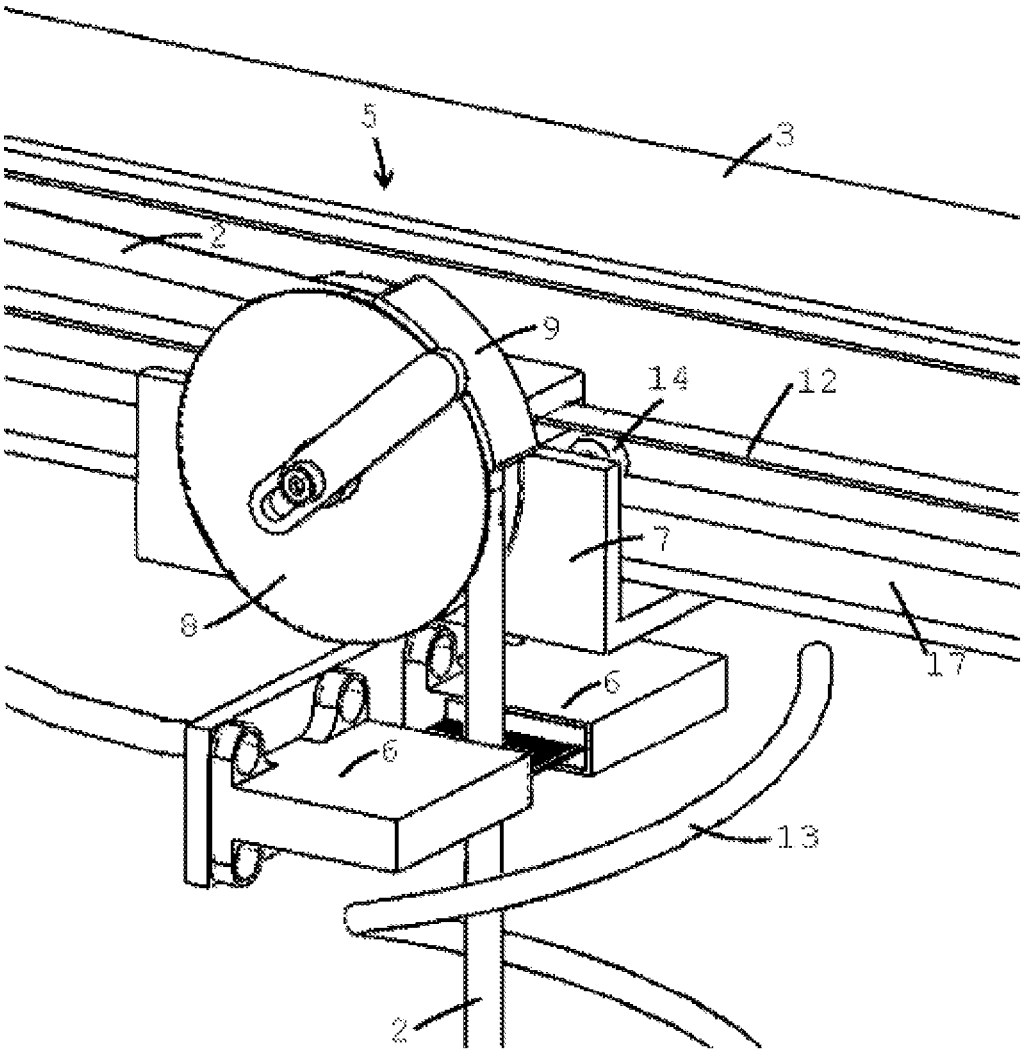
FIG. 7 shows a detail view in perspective of an embodiment example of the device according to the invention.
Figure 8:
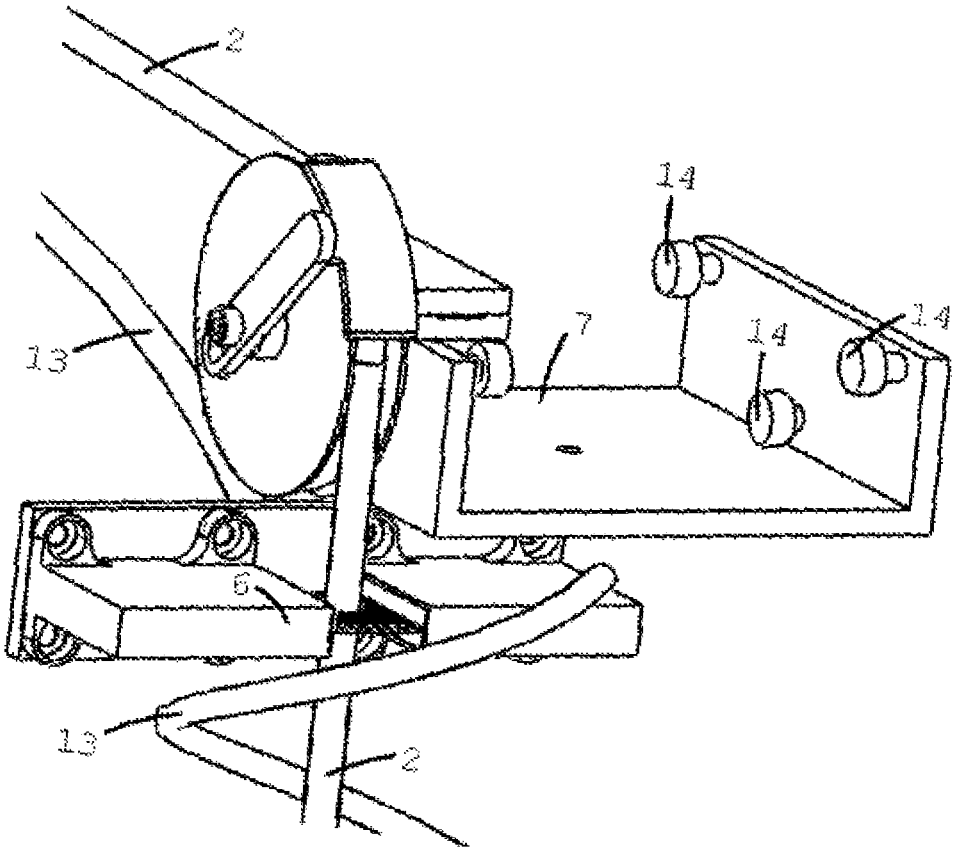
FIG. 8 shows a detail view in perspective of an embodiment example of the device according to the invention in order to illustrate the sensor for measuring a rope angle.

According to the invention, a sensor 6 is provided for measuring a rope angle of the load-bearing rope 2 relative to the vertical. The principle of the invention is illustrated in the diagrammatic side views of FIG. 3 and FIG. 4. The rope articulation point 5 is movably attached via a trolley 7 to the cantilever 3 of the load-bearing apparatus 1. In this embodiment, the rope articulation point 5 is a deflection roll 8 by which the load-bearing rope 2 is deflected without friction downward into the vertical. At a predefined distance beneath the rope articulation point 5, to the side of the load-bearing rope 2, a sensor 6 is provided. The sensor 6 is designed especially for measuring a rope angle of the load-bearing rope 2 relative to the vertical. As soon as an operating person moves the load attached to the gripping element 11 away from the vertical, the sensor 6 acquires the corresponding rope angle. The value of the rope angle is entered into a controller (not represented) or transmitted to said controller, and there an adjustment of the trolley 7 of the rope articulation point 5 is calculated via appropriate algorithms, by means of which adjustment the rope articulation point 5 needs be adjusted in order to bring the load-bearing rope 2 back to the vertical. In the case of an adjustment of the rope articulation point 5 via an actuating drive of the trolley 7 toward the front or toward the rear of the cantilever 3, according to the invention, the rope winding device 4 is activated at the same time via the controller that is adapted especially for this purpose, in order to adapt the effective length of the load-bearing rope 2 in accordance with the extent of the movement of the rope articulation point 5. In this manner, the load attached to the gripping element 11 remains at the same height as that set by an operating person for the shifting. Since the rope winding device 4 is mounted stationarily at the rear end of the cantilever 3, the height of the load would change in the case of an adjustment of the rope articulation point 5. According to the invention, this is prevented by activating, simultaneously with a shifting of the rope articulation point 5, the rope winding device 4 by the controller and adjust the rope length accordingly. In this way, a constant height of the load on the gripping element 11 is maintained.

Accordingly, by using the invention, a kind of active tracking of the position of the rope articulation point 5 and automatic adjustment of the rope angle are provided. The force for moving the load by an operating person is accordingly considerably reduced in comparison to conventional lifting aids of this type in which the operating person additionally must apply force for the adjustment of the rope articulation point 5 on the cantilever 3 and/or a turning of the cantilever 3 about the vertical rotation axle. Since the forces for moving the cantilever are thus decoupled from the user, rapid handling procedures for the dynamic shifting of loads become possible. The inert masses of the loads to be moved are clearly reduced in comparison to conventional lifting aids of this type. By the active tracking according to the invention of the position of the rope articulation point 5 and/or of the rotational position of the cantilever 3, a more intuitive use of the device 10 by an operating person becomes possible. Therefore, the work procedures for shifting loads can now be executed clearly more rapidly than in the case where the operating person must adjust a merely passively adjustable rope articulation point 5 additionally by a force applied to the load on the gripping element 11.

The cantilever 3 can be provided with an actuating drive on the vertical rotation axle. Using such an actuating drive, the swivel position of the cantilever 3 can also be actively tracked in accordance with a deflection of the load-bearing rope 2 on the basis of the rope angle measured by the sensor 6. In the represented first embodiment example of the invention, a vacuum gripper is provided as a gripping element 11. Said vacuum gripper can be supplied with a vacuum pressure, for example, via a low-pressure line 13 which is guided along the load-bearing rope 2. Alternatively, other gripping elements 11 can also be used, such as, for example, a force-transmitting glove or simple hook elements. The invention is also not limited to the represented form of a load-bearing apparatus 1 with a single swivelable cantilever 3 and can be transferred to various other load-bearing apparatuses of this type, by means of which a lifting aid for shifting loads becomes possible. The sensor 6 for measuring the rope angle is preferably a sensor with a one-dimensional measurement principle. However, other types of sensors can also be used as sensor 6, by means of which an adjustment of the load-bearing rope 2 away from the vertical can be measured. In the embodiment example shown, the sensor 6 is attached at a defined distance beneath the trolley 7 of the rope articulation point 5. The sensor 6 can be, for example, a line sensor or alternatively a sensor with a laser measurement directed from top down onto the gripping element 11. Thus, the rope angles relative to the vertical of a load-bearing rope 2 can be measured in different ways and used for the active adjustment of the rope angle according to the invention by means of the controller and the actuating drive of the trolley 7.

In FIGS. 5 to 8, different detail views of an embodiment example of a device 10 according to the invention in the area of a rope articulation point 5 are shown. The rope articulation point 5 of the load-bearing rope 2 is implemented here in the form of a deflection roll 8, which is provided with a lift-off protection 9 for preventing the lift-off of the load-bearing rope 2. The deflection roll 8 is mounted to the side on a trolley 7. The trolley 7 has a U shape in cross section and it is inserted from below on the cantilever 3. For mounting the trolley 7, the cantilever 3 which is substantially square in cross section is formed with sideways protruding ridges 17, to which inner rollers 14 of the trolley 7 are applied. For the adjustment of the trolley 7, a drive belt 12 is provided, which is deflected over a deflection roll at the free end of the cantilever 3 and which is adjusted via an actuating drive (not shown) provided in the rear area of the cantilever 3 by means of the controller in accordance with an acquired rope angle.

At a predetermined distance beneath the trolley 7, the sensor 6 for measuring the rope angle of the load-bearing rope 2 is provided. In this embodiment example, the sensor 6 is a so-called line sensor which allows a one-dimensional angle measurement. For this purpose, the sensor 6 comprises two facing sensor sections arranged next to the load-bearing rope 2 and attached to a sensor holding plate. The sensor 6 is connected to a controller (not shown), in which regulation algorithms are stored, which allow an active tracking of the rope articulation point 5 for the adjustment of the rope angle of the load-bearing rope 2. In addition, the controller, in accordance with the device 10 according to the invention, is coupled to the rope winding device 4, so that, simultaneously with the movement of the trolley 7 and thus of the rope articulation point 5, the load-bearing rope 2 is wound up or unwound accordingly, not only in order to maintain the load-bearing rope 2 in the vertical, but also in order to keep said carried load at a constant length between the rope articulation point 5 and the load carried by the gripping element 11. Since the controller, for an adjustment of the rope angle, is coupled directly to the actuating drive of the trolley 7 and to the rope winding device 4, the rope angle is immediately reduced again after a shifting of the load by an operating person, so that, in the case of a shift, the load-bearing rope 2 is always located substantially in the vertical position. Additional force for the tracking of a passive rope articulation point 5 is not necessary.

Figure 9:
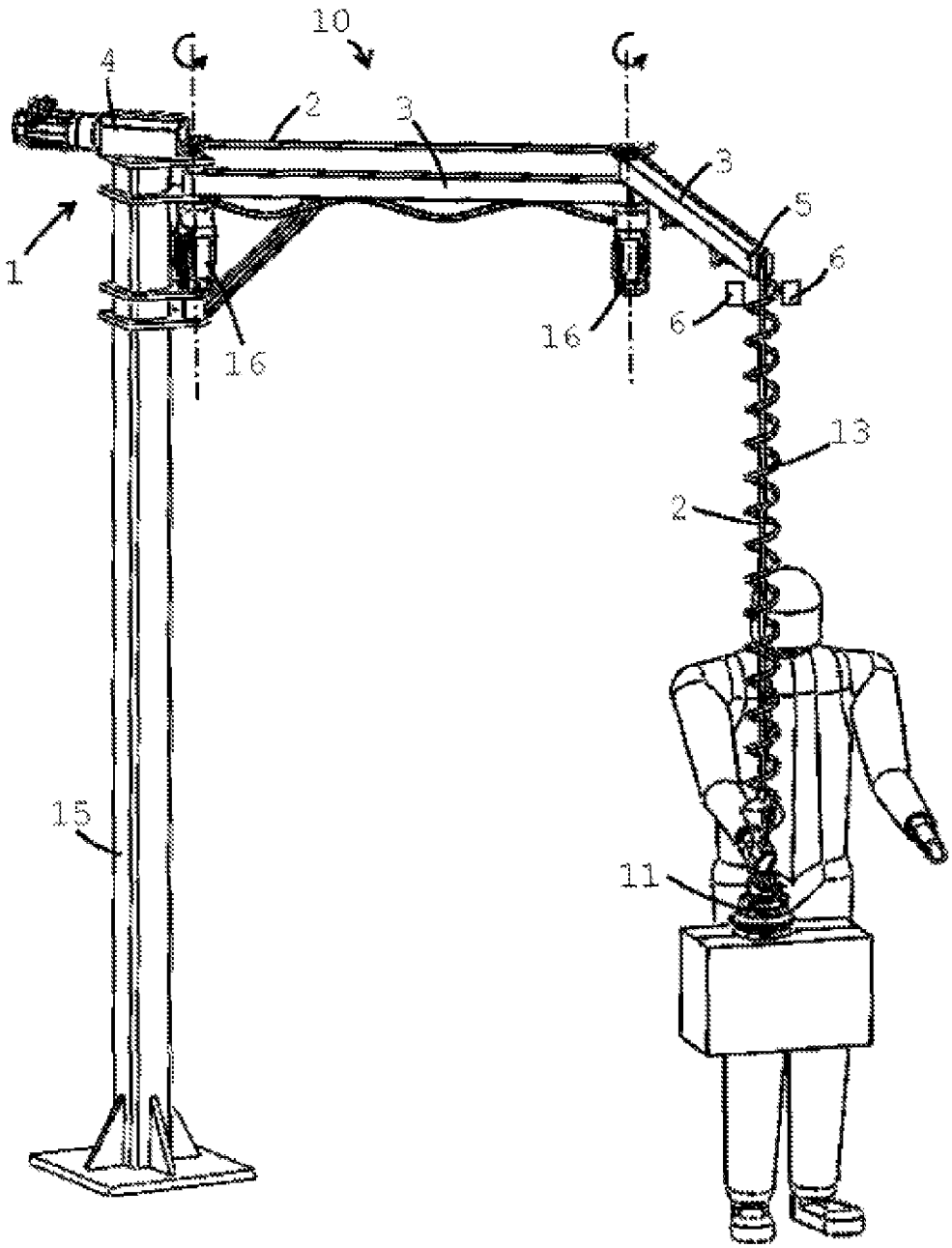
FIG. 9 shows a side view in perspective of a second embodiment example of a device according to the invention with a pivot arm cantilever.

FIG. 9 shows a second embodiment example of a device 10 according to the invention as a lifting aid for moving loads. In contrast to the above-described first embodiment example, the load-bearing apparatus 1 here does not consist of a single swivelable cantilever 3, but is implemented instead as a so-called pivot arm cantilever. On the post 15 of the load-bearing apparatus 1, a first section in the form of a swivelably mounted cantilever 3 is provided. The cantilever 3 is provided with an actuating drive 16 on the vertical rotation axle, so that the rotation position of the cantilever 3 can be adjusted by means of the controller (not shown) in accordance with a shifting of the load on the gripping element 11. A second cantilever 3 is provided on the front free end of the first cantilever 3 and is articulated via a second vertical rotation axle. The second cantilever 3 is also provided here with an actuating drive 16, by means of which the rotation position of the cantilever 3 can be actively adjusted. The rope articulation point 5 is located on the front free end of the second cantilever 3, over which the load-bearing rope 2 is guided vertically downward toward the gripping element 11. Here too, as an example, a vacuum gripper is shown as gripping element. Said vacuum gripper can be supplied, for example, via a low-pressure line 13, with a vacuum pressure from a vacuum device that is not represented. The rope winding device 4 is stationarily arranged at the upper end of the post 15.

In this embodiment as well, according to FIG. 9, a sensor 6 for measuring the rope angle is provided next to the controller according to the invention. If the load-bearing rope 2 between the rope articulation point 5 and the gripping element 11 is deflected away from the vertical by a force that is applied sideways to the load by an operating person, the controller determines, on the basis of the measured rope angle, the required adjustment of the cantilever 3 in order to adjust the load-bearing rope 2 again back to the vertical. On this basis, the actuating drives 16 on the rotation axes of the cantilevers 3 are adjusted in such a manner that the load-bearing rope 2 can be brought back again to the vertical. Using such a pivot arm cantilever of the load-bearing apparatus 1, the radius of action of the device 10 is increased further. Using the two rotation axles of the two cantilevers 3, which can be driven actively by means of the controller, a kind of two-dimensional movement in space can be achieved in addition to a linear adjustment of the rope articulation point. Here too, the controller is provided with corresponding regulation algorithms that calculate the required adjustment of the cantilever 3 on the basis of a measured rope angle.

The principle according to the invention of an active tracking of the position of the rope articulation point 5 in combination with the adjustment of the rope length of the load-bearing rope 2 can be used on different types of lifting aids and lifting devices of this type. For example, the invention can also be used with so-called scissor cantilevers. Instead of a vertical post 15, another form of load-bearing apparatus 1 can also be provided, for example, a frame, mounted on the ceiling, with different vertical cantilever elements.

The Scope of the Invention

It should be understood that, unless stated otherwise herein, any of the features, characteristics, alternatives or modifications described regarding a particular embodiment herein may also be applied, used, or incorporated with any other embodiment described herein. Also, the drawings herein are not drawn to scale.

Although the invention has been described and illustrated with respect to exemplary embodiments thereof, the foregoing and various other additions and omissions may be made therein and thereto without departing from the spirit and scope of the present invention.

The invention claimed is:

1. A device (10) for the hand-guided movement of loads by means of a retaining or gripping element (11) attached, as a lifting aid, to a load-bearing rope (2), with a load-bearing apparatus (1) which comprises a cantilever (3) over which the load-bearing rope (2) is guided from sides of a rope winding device (4) arranged on a load-bearing apparatus by means of an adjustable rope articulation point (5), wherein a length of the load-bearing rope (2) can be adjusted with the rope winding device (4), characterized in that a sensor (6) is provided for measuring a rope angle of the load-bearing rope (2) relative to the vertical, and in that a controller that works together with the sensor (6) is provided, and is set up so as to bring about simultaneously a shifting of the adjustable rope articulation point (5) and a change in the rope length of the load-bearing rope (2) as a function of the rope angle measured with the sensor (6).

2. A device according to claim 1, characterized in that the device comprises at least one actuating drive coupled to the controller, which is facilitated by the sensor (6), and configured for adjusting the rope articulation point (5).

3. A device (10) according to claim 2, characterized in that the controller activates an actuating device, for the active tracking of the rope articulation point (5) in a direction towards the adjustment of the rope angle of the load-bearing rope (2) towards the vertical.

4. A device (10) according to claim 2 characterized in that the controller is designed in such a manner that, in the case of a sideways shifting of the load, the rope length between load and cantilever (3) is kept constant.

5. A device (10) according to claim 2 characterized in that a trolley (7), which can be shifted on the cantilever (3) is provided, the trolley comprising the rope articulation point (5), wherein the shifting of the trolley (7) is controlled by the controller.

6. A device (10) according to claim 2 characterized in that the load-bearing apparatus (1) comprises vertical support for the cantilever (3), which can be swiveled sideways and which is provided with an actuating drive for the active turning of the cantilever (3) about a vertical rotation axle.

7. A device (10) according to claim 2, characterized in that the load-bearing apparatus (1) is a pivot arm cantilever with an additional vertical rotation axle, on which a pivot joint, which is adjustable via an actuating drive, is provided.

8. A device (10) according to claim 2, characterized in that the sensor (6) is designed for measuring a deflection distance of the load-bearing rope (2), wherein the sensor (6) is arranged at a predefined distance beneath the rope articulation point (5).

9. A device (10) according to claim 2, characterized in that the rope articulation point (5) is designed in the form of a deflection roll (8) with a lift-off protection (9).

10. A device (10) according to claim 1, characterized in that the controller activates an actuating device, for the active tracking of the rope articulation point (5) in a direction towards the adjustment of the rope angle of the load-bearing rope (2) towards the vertical.

11. A device (10) according to claim 10 characterized in that the controller is designed in such a manner that, in the case of a sideways shifting of the load, the rope length between load and cantilever (3) is kept constant.

12. A device (10) according to claim 10 characterized in that a trolley (7), which can be shifted on the cantilever (3), is provided, trolley which comprises the rope articulation point (5), wherein the shifting of the trolley (7) is controlled by the controller.

13. A device (10) according to claim 1 characterized in that the controller is designed in such a manner that, in the case of a sideways shifting of the load, the rope length between load and cantilever (3) is kept constant.

14. A device (10) according to claim 1 characterized in that a trolley (7), which can be shifted on the cantilever (3) is provided, the trolley comprising the rope articulation point (5), wherein the shifting of the trolley (7) is controlled by the controller.

15. A device (10) according to claim 14, characterized in that at least one actuating drive coupled to the controller is provided for the adjustment of the rope articulation point (5) in the longitudinal direction of the cantilever (3) and/or in a direction transverse to the longitudinal direction of the cantilever (3).

16. A device (10) according to claim 14, characterized in that at least one actuating drive coupled to the controller is provided for the adjustment of the trolley (7) in the longitudinal direction of the cantilever (3) and/or in a direction transverse to the longitudinal direction of the cantilever (3).

17. A device (10) according to claim 1 characterized in that the load-bearing apparatus (1) comprises a vertical support for the cantilever (3), which can be swiveled sideways and which is provided with an actuating drive for the active turning of the cantilever (3) about a vertical rotation axle.

18. A device (10) according to claim 1, characterized in that the load-bearing apparatus (1) is a pivot arm cantilever with an additional vertical rotation axle, on which a pivot joint, which is adjustable via an actuating drive, is provided.

19. A device (10) according to claim 1, characterized in that the sensor (6) is designed for measuring a deflection distance of the load-bearing rope (2), wherein the sensor (6) is arranged at a predefined distance beneath the rope articulation point (5).

20. A device (10) according to claim 1, characterized in that the rope articulation point (5) is designed in the form of a deflection roll (8) with a lift-off protection (9).

* * * * *